US009310127B2

(12) United States Patent
Teo

(10) Patent No.: US 9,310,127 B2
(45) Date of Patent: Apr. 12, 2016

(54) METHOD AND APPARATUS FOR LIQUEFYING A HYDROCARBON STREAM

(75) Inventor: Chee Seng Teo, The Hague (NL)

(73) Assignee: Shell Oil Company, Houston, TX (US)

( * ) Notice: Subject to any disclaimer, the term of this patent is extended or adjusted under 35 U.S.C. 154(b) by 1036 days.

(21) Appl. No.: 12/936,601

(22) PCT Filed: Apr. 7, 2009

(86) PCT No.: PCT/EP2009/054125

§ 371 (c)(1),
(2), (4) Date: Nov. 8, 2010

(87) PCT Pub. No.: WO2009/124925

PCT Pub. Date: Oct. 15, 2009

(65) Prior Publication Data

US 2011/0056237 A1 Mar. 10, 2011

Related U.S. Application Data

(63) Continuation-in-part of application No. 12/100,287, filed on Apr. 9, 2008, now Pat. No. 8,534,094.

(51) Int. Cl.
*F25J 1/00* (2006.01)
*F25J 1/02* (2006.01)

(52) U.S. Cl.
CPC ..... *F25J 1/0295* (2013.01); *F25J 1/0022* (2013.01); *F25J 1/0035* (2013.01); *F25J 1/0042* (2013.01);
(Continued)

(58) Field of Classification Search
CPC ..... F25J 1/0022; F25J 1/0042; F25J 1/0052; F25J 1/0055; F25J 1/0057; F25J 1/0082; F25J 1/0085; F25J 1/0087; F25J 1/021; F25J 1/0208; F25J 1/0214; F25J 1/0216; F25J 1/0219; F25J 1/023; F25J 1/0295; F25J 1/0035; F25J 2245/02; F25J 2220/62; F25J 2220/64; F25J 2230/08; F25J 2230/20; F25J 2230/30; F25J 2230/60
USPC ..... 62/611–614, 621
See application file for complete search history.

(56) References Cited

U.S. PATENT DOCUMENTS 3,983,711 A 10/1976 Solomon
4,541,852 A 9/1985 Newton et al. ..... 62/11
(Continued)

FOREIGN PATENT DOCUMENTS

WO 9859205 A2 12/1998
WO WO0188447 11/2001 ..... F25J 3/00

OTHER PUBLICATIONS

Conference paper PS2-7 at LNG 15; "How to reduce CO2 emissions in the LNG Chain" by Pierre Rabeau et al.; (Apr. 2007).*
(Continued)

*Primary Examiner* — Frantz Jules
*Assistant Examiner* — Keith Raymond

(57) ABSTRACT

Method and apparatus for liquefying a hydrocarbon stream. A liquefaction system comprises at least an NGL recovery system 12, a main refrigerant circuit 42 and a first refrigerant circuit 100, a pressure reduction device 52 followed by an end gas/liquid separator 62. The main refrigerant circuit 42 comprises at least one or more main refrigerant compressors 45, 45*a*, 45*b*, and the first refrigerant circuit comprises one or more first refrigerant compressors 101. A hydrocarbon feed stream 10 is passed through the NGL recovery system 12 to produce a methane-enriched overhead stream 20, which is subsequently cooled and liquefied by the first and second refrigerant circuits. The pressure of the liquefied stream is reduced and the resulting mixed-phase stream 60 is passed through the end gas/liquid separator 62 to provide an end gaseous stream 70 and a liquefied hydrocarbon product stream 80. The loading power of the one or more main refrigerant compressors and the one or more first refrigerant compressors is maximized to their maximum load by adjusting temperature of the liquefied stream to change the amount of end gaseous stream and by controlling an amount of the end gaseous stream being fed into the methane-enriched overhead stream 20 in a recycle stream 90*b*.

20 Claims, 4 Drawing Sheets

(52) U.S. Cl.
CPC ..... *F25J 1/0052* (2013.01); *F25J 1/0055* (2013.01); *F25J 1/0057* (2013.01); *F25J 1/021* (2013.01); *F25J 1/023* (2013.01); *F25J 1/0214* (2013.01); *F25J 1/0216* (2013.01); *F25J 1/0219* (2013.01); *F25J 2210/04* (2013.01); *F25J 2220/62* (2013.01); *F25J 2220/64* (2013.01); *F25J 2230/08* (2013.01); *F25J 2230/20* (2013.01); *F25J 2230/30* (2013.01); *F25J 2230/60* (2013.01); *F25J 2245/02* (2013.01)

(56) References Cited

U.S. PATENT DOCUMENTS

| | | | | |
|---|---|---|---|---|
| 5,036,671 | A * | 8/1991 | Nelson et al. | 62/612 |
| 5,615,561 | A | 4/1997 | Houshammand et al. | |
| 5,669,234 | A * | 9/1997 | Houser et al. | 62/612 |
| 6,041,620 | A * | 3/2000 | Olszewski et al. | 62/612 |
| 6,272,882 | B1 * | 8/2001 | Hodges et al. | 62/613 |
| 6,427,483 | B1 * | 8/2002 | Rashad et al. | 62/613 |
| 6,712,880 | B2 | 3/2004 | Foglietta et al. | |
| 6,889,523 | B2 | 5/2005 | Wilkinson et al. | |
| 7,237,407 | B2 | 7/2007 | Paradowski | |
| 2004/0177646 | A1 | 9/2004 | Wilkinson et al. | |
| 2006/0213222 | A1 * | 9/2006 | Whitesell | 62/612 |
| 2007/0012072 | A1 | 1/2007 | Qualls et al. | |
| 2007/0157663 | A1 | 7/2007 | Mak et al. | |
| 2009/0301131 | A1 * | 12/2009 | Bakker et al. | 62/623 |

OTHER PUBLICATIONS

Conference paper PS2-7 at LNG 15 (Barcelona) "How to reduce CO2 emissions in the LNG Chain" by Pierre Rabeau et al.

15th International Conference & Exhibition on Liquefied Natural Gas—Barcelona (Spain), Newsletter; http://www.lng15.com/index.asp?urlgo=newsletter.

15th International Conference & Exhibition on Liquefied Natural Gas—Barcelona (Spain), Newsletter No. 1—Aug. 2006; http://www.lng15.com/news/newsletter01ENG.html.

15th International Conference & Exhibition on Liquefied Natural Gas—Barcelona (Spain), Newsletter No. 2—Oct. 2006; http://www.lng15.com/news/newsletter02ENG.html.

15th International Conference & Exhibition on Liquefied Natural Gas—Barcelona (Spain), Newsletter No. 3—Jan. 2007; http://www.lng15.com/news/newsletter03ENG.html.

15th International Conference & Exhibition on Liquefied Natural Gas—Barcelona (Spain), Newsletter No. 4—Mar. 2007; http://www.lng15.com/news/newsletter04ENG.html.

15th International Conference & Exhibition on Liquefied Natural Gas—Barcelona (Spain), Newsletter No. 5—Apr. 2007; http://www.lng15.com/news/newsletter05ENG.html.

15th International Conference & Exhibition on Liquefied Natural Gas—Barcelona (Spain), Find out the latest before you even get here; http://www.lng15.com/index.asp?urlgo=newsletter504.

* cited by examiner

METHOD AND APPARATUS FOR LIQUEFYING A HYDROCARBON STREAM

CROSS REFERENCE TO EARLIER APPLICATIONS

The present application is a national stage application of International application No. PCT/EP2009/054125, filed 7 Apr. 2009, which is a continuation-in-part of currently U.S. application Ser. No. 12/100,287, filed 9 Apr. 2008 now U.S. Pat. No. 8,534,094.

FIELD OF THE INVENTION

The present invention relates to a method and apparatus for liquefying a hydrocarbon stream, for instance a natural gas stream.

BACKGROUND OF THE INVENTION

Natural gas is a useful fuel source, as well as being a source of various hydrocarbon compounds. It is often desirable to liquefy natural gas in a liquefied natural gas (LNG) plant at or near the source of a natural gas stream for a number of reasons. As an example, natural gas can be stored and transported over long distances more readily as a liquid than in gaseous form because it occupies a small volume and does not need to be stored at high pressure.

Usually, natural gas, comprising predominantly methane, enters an LNG plant at elevated pressures and is pre-treated to produce a purified feed stream suitable for liquefaction at cryogenic temperatures. The purified gas is processed through a plurality of cooling stages using heat exchangers to progressively reduce its temperature until liquefaction is achieved. The liquid natural gas is then further cooled and expanded to final atmospheric pressure suitable for storage and transportation.

In addition to methane, natural gas usually includes some heavier hydrocarbons and impurities, including but not limited to carbon dioxide, sulphur, hydrogen sulphide and other sulphur compounds, nitrogen, helium, water, other non-hydrocarbon acid gases, ethane, propane, butanes, $C_5$+ hydrocarbons and aromatic hydrocarbons. These and any other common or known heavier hydrocarbons and impurities either prevent or hinder the usual known methods of liquefying the methane, especially the most efficient methods of liquefying methane. Most known or proposed methods of liquefying hydrocarbons, especially liquefying natural gas, are based on reducing as far as possible the levels of at least most of the heavier hydrocarbons and impurities prior to the liquefying process.

Hydrocarbons heavier than methane and usually ethane are typically condensed and recovered as natural gas liquids (NGLs) from a natural gas stream. The methane is usually separated from the NGLs in a high pressure scrub column, and the NGLs are then subsequently fractionated in a number of dedicated distillation columns to yield valuable hydrocarbon products, either as product steams per se or for use in liquefaction, for example as a component of a refrigerant.

Meanwhile, the methane from the scrub column is subsequently liquefied to provide LNG. Pressure reduction and separation such as 'end flash' after liquefaction can provide a gaseous methane recycle stream.

U.S. Pat. No. 4,541,852 describes a system for liquefying and subcooling natural gas in which compression power is redistributed from the closed cycle refrigerant by subcooling the LNG and reducing the pressure and flashing the LNG to recover a gaseous phase natural gas. The gaseous phase natural gas is then recompressed and recycled to the feed of the system.

The system of U.S. Pat. No. 4,541,852 requires the recompression of the gaseous phase natural gas from the depressurisation and flashing of the LNG to the feed stream pressure of 815 psia. A high power recompressor driver is therefore required.

The system of U.S. Pat. No. 4,541,852 does not include an NGL extraction system. Thus, it is not possible to alter the specification of the LNG product by removing NGLs from the feed stream. Any hydrocarbon components in the feed stream which may solidify during liquefaction may cause plugging in the system.

SUMMARY OF THE INVENTION

In a first aspect, the present invention provides a method of liquefying a hydrocarbon stream, comprising at least the steps of:

(a) providing a liquefaction system comprising at least an NGL recovery system, a main refrigerant circuit and a first refrigerant circuit and a pressure reducing device followed by an gas/liquid separator, the main refrigerant circuit comprising at least one or more main refrigerant compressors, and the first refrigerant circuit comprising one or more first refrigerant compressors;

(b) passing a hydrocarbon feed stream through the NGL recovery system to produce a methane-enriched overhead stream from the hydrocarbon feed stream;

(c) passing the methane-enriched overhead stream through at least a first compressor to provide a methane-compressed stream;

(d) cooling the methane-compressed stream against a first refrigerant in the first refrigerant circuit and subsequently liquefying the methane-compressed stream against a main refrigerant in the main refrigerant circuit, to provide a first liquefied stream;

(e) reducing the pressure of the first liquefied stream to provide a mixed-phase stream;

(f) passing the mixed-phase stream through an end gas/liquid separator to provide an end gaseous stream and a liquefied hydrocarbon product stream;

(g) feeding at least a recycle fraction of the end-gaseous stream into the methane-enriched overhead stream or the methane-compressed stream upstream of at least a part of said cooling against the first refrigerant in the first refrigerant circuit;

(h) maximizing of the loading power of the one or more main refrigerant compressors and the one or more first refrigerant compressors to their maximum load by adjusting the temperature ($T_x$) of the first liquefied stream to change the amount of the end gaseous stream from the end gas/liquid separator and controlling the amount in the recycle fraction of the end-gaseous stream being fed in step (g).

In a second aspect, the present invention provides an apparatus for liquefying a hydrocarbon stream, the apparatus at least comprising:

an NGL recovery system to extract a $C_2$+ stream from a hydrocarbon feed stream to provide at least a methane-enriched overhead stream and a $C_2$+ enriched bottom stream;

at least a first compressor to provide a methane-compressed stream from the methane-enriched overhead stream;

a first cooling stage to cool the methane-compressed stream to provide a cooled methane-compressed, followed by a main cooling stage to liquefy the cooled methane-compressed stream to provide a first liquefied stream;

a pressure reducing device to reduce the pressure of the first liquefied stream to provide a mixed-phase stream;

an end gas/liquid separator to separate the mixed-phase stream into an end gaseous stream and a liquefied hydrocarbon product stream; and a recycle fraction line to feed at least a recycle fraction of the end-gaseous stream into the methane-enriched overhead stream a control system arranged to maximize the loading power of the one or more main refrigerant compressors and the one or more first refrigerant compressors at their maximum load, by adjusting the temperature ($T_x$) of the first liquefied stream to change the amount of the end gaseous stream from the end gas/liquid separator, and to control the amount in the recycle fraction of the end-compressed stream in the recycle fraction line.

Embodiments and examples of the present invention will now be described by way of example only and with reference to the accompanying non-limited drawings.

For the purpose of this description, a single reference number will be assigned to a line as well as a stream carried in that line. Throughout this application, the use of the unit bar is understood to refer to absolute pressure.

DETAILED DESCRIPTION OF THE INVENTION

Described herein are methods of controlling the liquefaction of a hydrocarbon feed stream and apparatuses therefore, and/or for maximizing the production of a liquefied hydrocarbon stream. Embodiments of these methods are based on adjusting the temperature ($T_x$) of the first liquefied stream to change the amount of the end gaseous stream from the end gas/liquid separator; and controlling the amount of a recycle fraction of the end-compressed stream being fed into the methane-enriched overhead stream.

This allows for shifting of the compression power between first and second refrigerant circuits, and increasing the compression power (preferably to full loading) of both the first and second refrigerant circuits to produce more of the liquefied hydrocarbon product stream. Thus, the adjusting of $T_x$ and the controlling of the amount of the recycle fraction may allow for driving each of the main refrigerant compressors and first refrigerant compressors at their maximum load.

Instead of, or in addition to increasing the compression power, the methods and apparatus according to the invention may also be employed allow for a control over the specification, sometimes referred to as quality, of the produced liquefied hydrocarbon product stream as a result of the temperature adjustment of the first liquefied stream.

Advantageously, embodiments of the invention provide a method for liquefying a hydrocarbon stream using NGL recovery to improve the separation of $C_2$+ hydrocarbons from the hydrocarbon stream, and also to provide a more efficient location for the recycle of end-compressed stream back into the liquefaction process.

Figure 1:
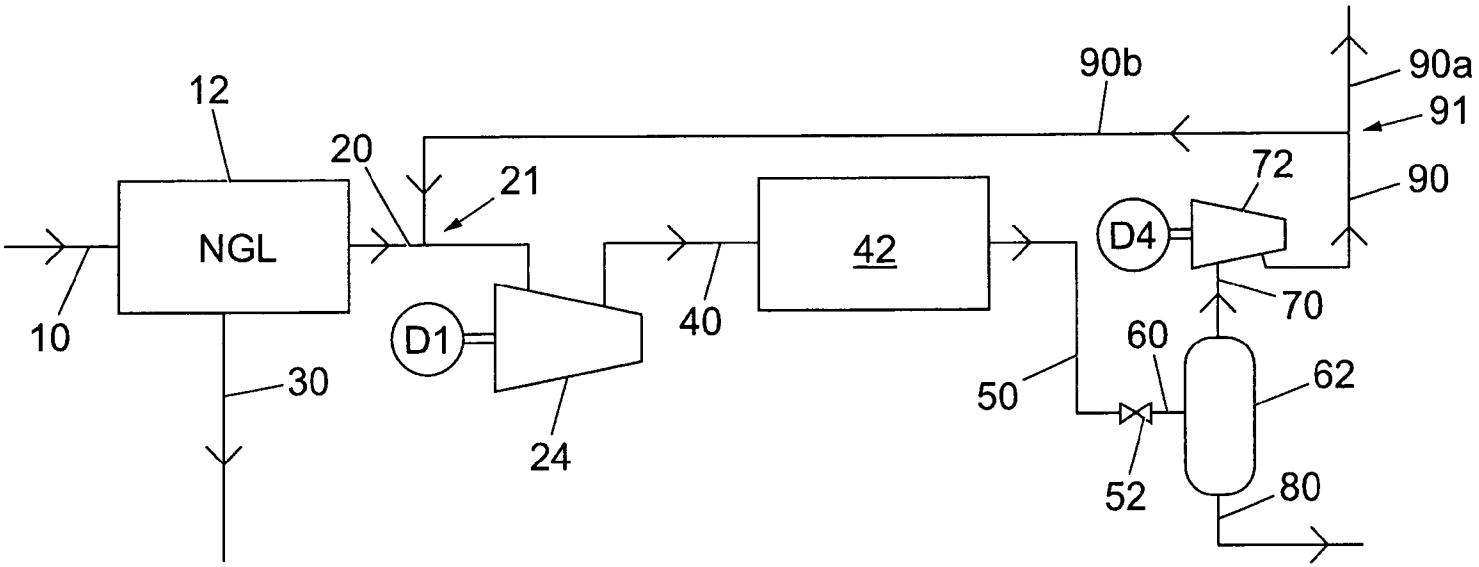
FIG. 1 is a diagrammatic scheme of a method of liquefying a hydrocarbon stream.

Referring to the drawings, FIG. 1 shows an apparatus for liquefying a hydrocarbon stream in accordance with an embodiment. It comprises:

an NGL recovery system 12 to extract a $C_2$+ stream from a hydrocarbon feed stream 10 to provide at least a methane-enriched overhead stream 20 and a $C_2$+ enriched bottom stream 30;

at least a first compressor 24 to provide a methane-compressed stream 40 from the methane-enriched overhead stream 20;

a main cooling stage 42 to liquefy the methane-compressed stream 40 to provide a first liquefied stream 50;

a pressure reducing device 52 to reduce the pressure of the first liquefied stream 50 to provide a mixed-phase stream 60;

an end gas/liquid separator 62 to separate the mixed-phase stream 60 into an end gaseous stream 70 and a liquefied hydrocarbon product stream 80;

one or more end-compressors 72 to compress the end gaseous stream 70 to provide an end-compressed stream 90; and a recycle fraction line **90*b* connecting the end-compressed stream 90 with the methane-enriched overhead stream 20 to feed at least a recycle fraction of the end-compressed overhead stream 90 into the methane-enriched overhead stream 20**.

FIG. 1 may also be used to illustrate a method of liquefying a hydrocarbon stream according to one embodiment. The method at least comprises the steps of:

providing a hydrocarbon feed stream 10;

passing the hydrocarbon feed stream 10 through an NGL recovery system 12 to separate the hydrocarbon feed stream 10 into at least a methane-enriched overhead stream 20 and a $C_2$+ enriched bottom stream 30;

passing the methane-enriched overhead stream 20 through at least a first compressor 24 to provide a methane-compressed stream 40;

liquefying the methane-compressed stream 40 to provide a first liquefied stream 50;

reducing the pressure of the first liquefied stream 50 to provide a mixed-phase stream 60;

passing the mixed-phase stream 60 through an end gas/liquid separator 62 to provide an end gaseous stream 70 and a liquefied hydrocarbon product stream 80;

passing the end gaseous stream 70 through one or more end-compressors 72 to provide an end-compressed stream 90; and feeding at least a recycle fraction **90*b* of the end-compressed stream 72 into the methane-enriched overhead stream 20**.

The hydrocarbon stream may be any suitable hydrocarbon stream such as, but not limited to, a hydrocarbon-containing gas stream able to be cooled. One example is a natural gas stream obtained from a natural gas or petroleum reservoir. As an alternative the natural gas stream may also be obtained from another source, also including a synthetic source such as a Fischer-Tropsch process.

Usually such a hydrocarbon stream is comprised substantially of methane. Preferably such a hydrocarbon stream comprises at least 50 mol % methane, more preferably at least 80 mol % methane.

Although the method disclosed herein is applicable to various hydrocarbon streams, it is particularly suitable for natural gas streams to be liquefied. As the skilled person readily understands how to liquefy a hydrocarbon stream, this is not discussed herein in detail.

Depending on the source, the hydrocarbon stream may contain one or more non-hydrocarbons such as $H_2O$, $N_2$, $CO_2$, Hg, $H_2S$ and other sulfur compounds.

If desired, the hydrocarbon stream may be pre-treated before use, either as part of a hydrocarbon cooling process, or separately. This pre-treatment may comprise reduction and/or removal of non-hydrocarbons such as $CO_2$ and $H_2S$ or other steps such as early cooling and pre-pressurizing. As these steps are well known to the person skilled in the art, their mechanisms are not further discussed here.

Thus, the term "hydrocarbon stream" as used herein also includes a composition prior to any treatment, such treatment including cleaning, dehydration and/or scrubbing, as well as any composition having been partly, substantially or wholly treated for the reduction and/or removal of one or more compounds or substances, including but not limited to sulfur, sulfur compounds, carbon dioxide and water.

Preferably, a hydrocarbon stream to be used herein undergoes at least the minimum pre-treatment required to subsequently allow liquefaction of the hydrocarbon stream. Such a requirement for liquefying natural gas is known in the art.

A hydrocarbon stream commonly also contains varying amounts of hydrocarbons heavier than methane such as ethane, propane, butanes and pentanes, as well as some aromatic hydrocarbons. The composition varies depending upon the type and location of the hydrocarbon stream. Hydrocarbons heavier than methane generally need to be removed from natural gas to be liquefied for several reasons, such as having different freezing or liquefaction temperatures that may cause them to block parts of a methane liquefaction plant. $C_{2-4}$ hydrocarbons can be used as a source of natural gas liquids (NGLs) and/or refrigerant.

Scrub columns operating at the high pressures used in the liquefaction process, which is conventionally carried out at 40 to 70 bar pressure, can be used to remove $C_5$+ hydrocarbons from the hydrocarbon stream, for example to provide a scrubbed stream with less than 0.1 mol % $C_5$+ hydrocarbons.

However, high pressure separation of methane and NGLs such as in a scrub column is not as efficient as carrying the separation process out at a lower pressure, but maintaining the high pressure has conventionally been favoured in order to avoid the CAPEX and OPEX required to expand and then recompress the main hydrocarbon stream.

Consequently, in some circumstances, a scrub column may not provide the desired LNG specification. For example, the LNG specification required for the United States of America should comprise no more than 1.35 mol % $C_4$+, no more than 3.25 mol % propane and no more than 9.2 mol % ethane. One way of providing such a specification is to carry out the separation of NGLs at a lower pressure, for example in the range of 15 to 45 bar, more preferably 20 to 35 bar. For example, separation of $C_3$+ hydrocarbons from the hydrocarbon stream is preferably carried out in a pressure range of 30 to 35 bar, more preferably 33 bar, while the separation of $C_2$+ hydrocarbons is preferably carried out in a lower pressure range of 20 to 25 bar, more preferably 23 bar. After NGL extraction at these pressures, the hydrocarbon stream must then be further compressed prior to liquefaction. FIG. 1 shows a method of liquefying a hydrocarbon stream according to one embodiment disclosed herein, wherein a hydrocarbon feed stream 10 is passed into an NGL recovery system 12.

The hydrocarbon feed stream 10 is provided from a hydrocarbon stream as defined above, and may undergo one or more further processes or treatments prior to the NGL recovery system 12. For example, the hydrocarbon feed stream 10 may be cooled by one or more heat exchangers as discussed hereafter.

The hydrocarbon feed stream 10 may be provided as a low pressure mixed-phase feed stream ready for passing into an NGL recovery column 14 (shown in FIG. 2) as part of the NGL recovery system 12.

Alternatively and/or additionally, the NGL recovery system 12 may include at least a first expander 15 (shown in FIG. 2) able to expand the hydrocarbon feed stream 10 to provide a mixed-phase feed stream 16 for the NGL recovery column 14.

The NGL recovery system 12 provides a methane-enriched overhead stream 20 and a $C_2$+ enriched bottom stream 30 in a manner known in the art. By operating at a low pressure, for example ≤35 bar, the NGL recovery column 14 of the NGL recovery system 12 provides a more efficient separation of methane and $C_2$+ hydrocarbons than a conventional scrub column.

The $C_2$+ enriched bottom stream 30 can pass to an optional fractionation train (not shown) comprising one or more separators such as one or more distillation columns or a fractionation column, to provide individual hydrocarbon streams such as an ethane stream, a propane stream and a butanes stream, or a combination of same, either for separate use, or for at least partial use as one or more of the components of one or more of the refrigerants of the method of liquefying a hydrocarbon stream disclosed herein.

The methane-enriched overhead stream 20 may still comprise a minor (<10 mol %) amount of $C_2$+ hydrocarbons, and is preferably >80 mol %, more preferably >90 mol %, methane and nitrogen.

The methane-enriched overhead stream 20 is passed through a first compressor 24 to provide a methane-compressed stream 40. The first compressor 24 may comprise one or more compressors, stages and/or sections in a manner known in the art, and is intended to provide a methane-compressed stream 40 having a pressure in the range of 30 to 80 bar, preferably from 35 or 40 bar to 80 bar, more preferably from 45 bar to 80 bar. The pressure or the lower limit of the pressure range may be selected in dependence of the pressure at which the methane-enriched overhead stream 20 is discharged from the NLG recovery system.

The methane-compressed stream 40 is then liquefied to provide a first liquefied stream 50. Liquefaction of the methane-compressed stream 40 can be carried out by one or more cooling stages comprising one or more heat exchangers wherein the methane-compressed stream may be heat exchanged against an evaporating refrigerant. FIG. 1 shows by way of example a 'main' cooling stage 42 able to cool the methane-compressed stream 40 to a temperature of at least −100° C.

The main cooling stage 42 may comprise one or more main refrigerant circuits. At least one of the main refrigerant circuits may comprise a mixed refrigerant comprising two or more of the group consisting of nitrogen, methane, ethane, ethylene, propane, propylene, butanes and pentanes. Before this liquefying in the main cooling stage 42, the hydrocarbon feed stream 10 and/or the methane-compressed stream 40 may be cooled by one or more first refrigerant circuits comprising one or more first refrigerant circuit compressors. The refrigerant of the first refrigerant circuit may consist essentially of one or more of the group consisting of nitrogen, methane, ethane, ethylene, propane, propylene, butanes and pentanes.

The pressure of the first liquefied stream 50 is then reduced to provide a mixed-phase stream 60. Reduction in the pressure of a liquefied stream may be carried out by any suitable apparatus, unit or device known in the art, such as an expansion device, such as one or more valves and/or one or more expanders. FIG. 1 shows the example of using a valve 52.

The mixed-phase stream 60 is then passed into an end gas/liquid separator 62, such as an end-flash vessel known in the art, wherein there is provided a liquefied hydrocarbon product stream 80, and an end gaseous stream 70, such as an end-flash gas stream. The pressure of the liquefied hydrocarbon product stream 80 and/or that of the end gaseous stream 70 may be near atmospheric, for instance less than 1.5 bar.

The liquefied hydrocarbon product stream 80 can then be passed by one or more pumps (not shown) to storage and/or transportation facilities. Where the hydrocarbon feed stream 10 is natural gas, the liquefied hydrocarbon product stream 80 is LNG.

The end gaseous stream 70, such as end-flash gas, from the end gas/liquid separator 62 then passes through one or more end-compressors 72 to provide an end-compressed stream 90. The end-compressor(s) 72 may be any suitable compressor(s) having one or more stages and/or sections known in the art, and is intended to provide an end-compressed stream 90 having a pressure of >20 bar.

The end-compressed stream 90 is divided by a stream splitter 91 known in the art, to provide a recycle fraction 90*b* and a fuel-gas fraction 90*a*. The end-compressed stream 90 may also be used for one or more other purposes such as to provide cooling to one or more heat exchangers, and may provide one or more other fractions for use other than recycle and a fuel stream. Other uses for an end-compressed stream 90 are known in the art.

The division of the end-compressed stream 90 by the stream splitter 91 may be anywhere in the range 0-100%, based on the requirements for the recycle fraction 90*b* as discussed below.

The recycle fraction 90*b* is conveniently at the same or similar pressure to the methane-enriched overhead stream 20 such that it can be readily fed into the methane-enriched overhead stream 20 by a combiner 21 upstream of the first compressor 24.

Figure 2:
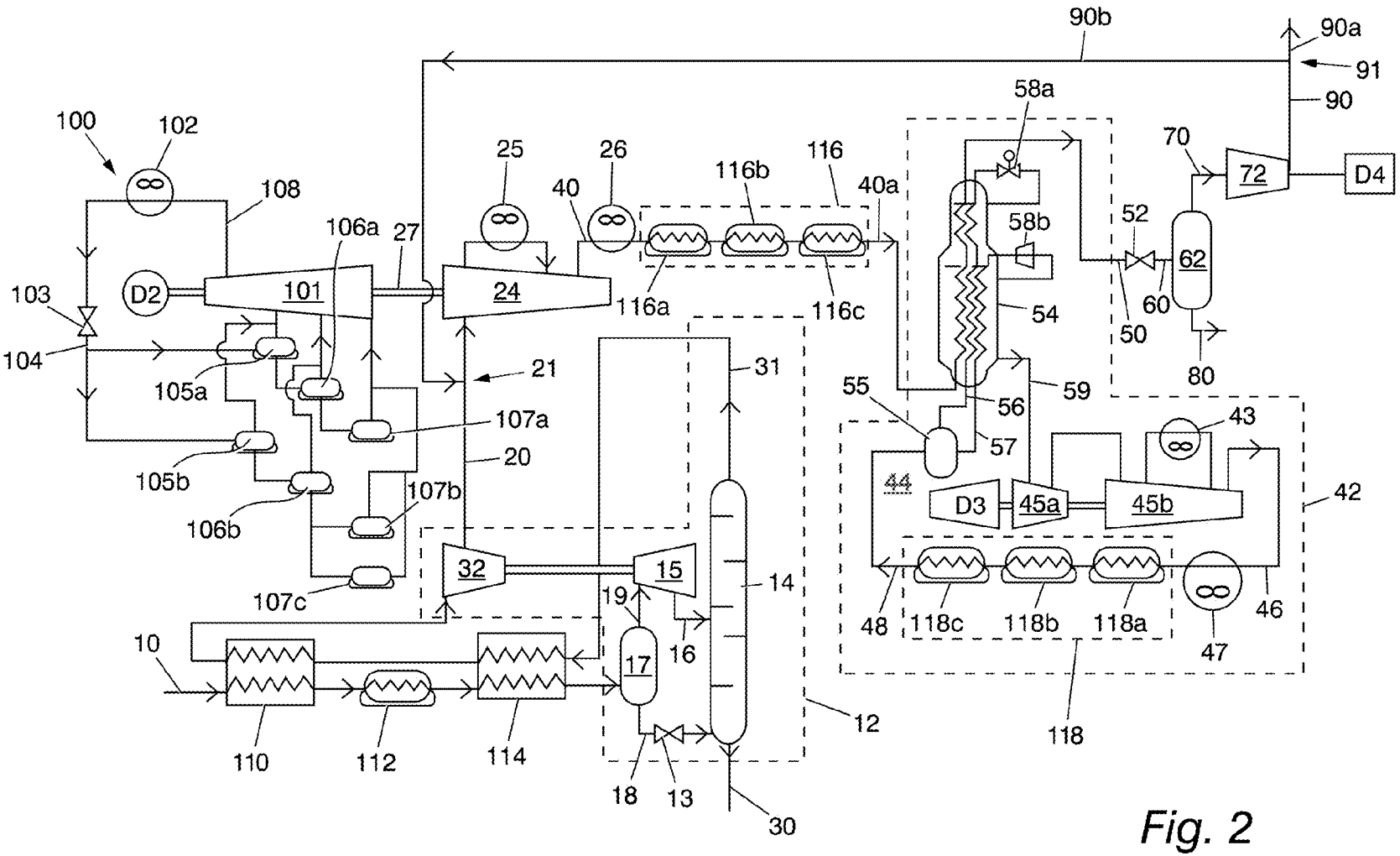
FIG. 2 is a more detailed diagrammatic scheme of a method of liquefying a hydrocarbon stream.

FIG. 2 shows a method of liquefying a hydrocarbon stream according to a second embodiment disclosed herein.

In FIG. 2, the hydrocarbon feed stream 10 is passed through a first heat exchanger 110, a second heat exchanger 112, preferably being a low pressure kettle heat exchanger, and a third heat exchanger 114, prior to passing into the NGL recovery system 12. In this way, the temperature of the hydrocarbon feed stream 10 can be lowered to below 0° C. The pressure may be anywhere in the range of from 40 to 80 bar, preferably of from 45 to 80 bar.

In FIG. 2, the NGL recovery system 12 comprises a pre-NGL separator 17, able to provide a bottom liquid stream 18 which passes through a valve 13 and into the NGL recovery column 14, and an overhead gaseous stream 19 which passes into the NGL expander 15 to provide a mixed-phase feed stream 16 which passes into the NGL recovery column 14 at a height above the bottom liquid stream 18.

The NGL recovery column 14 provides a $C_2$+ enriched bottom stream 30, and an overhead stream 31 which passes through the first and third heat exchangers 110, 114 to provide some cooling to the hydrocarbon feed stream 10. Thereafter, the overhead stream 31 can pass through a turbo-compressor 32 which is preferably mechanically interlinked with, and driven directly by, the NGL expander 15 so as to capture work energy created by the NGL expander 15 in a manner known in the art. The turbo-compressor provides the methane-enriched overhead stream 20 that is provided from the NGL recovery system 12.

As described above, the methane-enriched overhead stream 20 can be combined by a combiner 21 with a recycle fraction 90*b* of the end-compressed stream 90, to provide a feed stream into the one or more first compressors 24. Optionally, an intercooler 25 may be provided with one or more first compressors 24. The provided methane-compressed stream 40 may be cooled by a first cooler 26. The intercooler 25 and first cooler 26 may be water and/or air coolers known in the art. The methane-compressed stream 40 can pass through a fourth heat exchanger or heat exchanger system 116, preferably being a high pressure kettle heat exchanger 116*a*, a medium pressure heat exchanger 116*b* and a low pressure heat exchanger 116*c*, wherein it can exchange heat with a refrigerant evaporating at the various relative pressure levels indicated above, to provide a cooled methane-compressed stream 40*a* prior to entering the main cooling stage 42.

According to one embodiment disclosed herein, there is provided a first refrigerant circuit 100 comprising a first refrigerant compressor 101 (being one or more compressors), driven by a first refrigerant compressor driver D2, which provides a compressed refrigerant stream 108. Compressed refrigerant stream 108 is passed through one or more coolers 102 and a valve 103 to provide a cooled expanded refrigerant stream 104 into one or more heat exchangers. By way of example only, FIG. 2 shows the first refrigerant circuit 100 having a division of the refrigerant supply to two parallel first high pressure (HP) kettle heat exchangers 105*a*, 105*b*. Each first high pressure heat exchanger 105*a*, 105*b* then passes refrigerant via an expansion device (not shown) to medium pressure (MP) kettle heat exchangers 106*a*, 106*b*. The refrigerant from medium pressure kettle heat exchanger 106*a* is supplied to a low pressure (LP) kettle heat exchanger 107*a*. In the embodiment shown in FIG. 2, the refrigerant from medium pressure (MP) kettle heat exchanger 106*b* is divided to supply two low pressure heat exchangers 107*b*, 107*c*. Optionally, low pressure heat exchanger 107*c* can correspond to the second heat exchanger 112 to cool the hydrocarbon feed stream 10. The refrigerant from the low pressure kettle heat exchangers 107*a*, 107*b*, 112 is then re-compressed by the first refrigerant compressor 101.

Further optionally, one of the HP heat exchangers 105*a*, 105*b* can correspond to the fourth HP heat exchanger 116*a* able to provide cooling to the methane-compressed stream 40 after the first compressor 24. Similarly, one of the MP heat exchangers 106*a*, 106*b* can correspond to the fourth MP heat exchanger 116*b* and one of the LP heat exchangers 107*a*, 107*b* can correspond to fourth LP heat exchanger 116*c*.

The provision of a first refrigerant circuit in a process for liquefying a hydrocarbon stream is known in the art, and is sometimes termed a 'pre-cooling refrigerant circuit'. A first refrigerant circuit may also provide some cooling to one or more other streams, including refrigerant in one or more other refrigerant circuits in the hydrocarbon liquefaction process, such as the main refrigerant in a main refrigerant circuit.

The first refrigerant of the first refrigerant circuit may be a single component refrigerant such as consisting essentially of propane or propylene, preferably propane, or a refrigerant comprising one or more components selected from the group comprising nitrogen, methane, ethane, ethylene, propane, propylene, butanes and pentanes.

The first compressor 24 may be driven by a dedicated driver D1 (such as for example indicated in FIG. 1). However, the first refrigerant compressor driver D2 of the first refrigerant compressor 101 may also drive the first compressor 24.

For instance, in the embodiment as shown in FIG. 2, the first compressor 24 and at least one refrigerant compressor 101 are mechanically interlinked and commonly driven, typically by use of a common drive shaft 27. An advantage of such a common drive scheme is that excess available power from the first refrigerant circuit can thus be used not only for providing more cooling duty to the first refrigerant which is desired to increase the production, but also to recompress additional recycle gas which is produced as a result of a higher $T_x$.

The cooled methane-compressed stream 40*a* from the fourth heat exchanger system 116 passes into the main cooling stage 42. The fourth heat exchanger system may comprise one of more fourth high pressure kettle heat exchangers 116*a*, one or more fourth medium pressure heat exchangers 116*b* and one or more fourth low pressure heat exchangers 116*c*. Only a single fourth HP, MP and LP kettle heat exchanger 116*a*, 116*b*, 116*c* respectively is shown in FIG. 2.

The main cooling stage 42 may comprise one or more heat exchangers and one or more refrigerant circuits, either being in series, parallel or both. FIG. 2 shows the main cooling stage 42 having a main cryogenic heat exchanger (MCHE) 54 such as a spool wound heat exchanger, able to cool and at least partly liquefy the cooled methane-compressed stream 40*a* by heat exchange against a main refrigerant to provide the first liquid stream 50.

FIG. 2 also shows the main cooling stage 42 having a main refrigerant circuit 44 which may use any refrigerant, preferably a mixed refrigerant comprising two or more of the group comprising: nitrogen, methane, ethane, ethylene, propane, propylene, butanes and pentanes.

The main refrigerant circuit 44 may involve any number of refrigerant compressors, coolers and separators to provide one or more refrigerant streams to the MCHE 54 in a manner known in the art.

By way of example only, FIG. 2 shows the main refrigerant circuit 44 having first and second main refrigerant compressors 45*a*, 45*b*, which are commonly driven by a main refrigerant compressor driver D3, to provide a pressurised refrigerant stream 46 which passes through one or more coolers 47, such as one or more water and/or air coolers, followed by a fifth heat exchanger system 118, comprising one or more fifth HP kettle heat exchangers 118*a*, one or more fifth MP kettle heat exchangers 118*b* and one or more fifth LP kettle heat exchangers 118*c*. Only a single fifth HP, MP and LP kettle heat exchanger 118*a*, 118*b*, 118*c* is shown in FIG. 2. The fifth HP, MP and LP heat exchangers 118*a*, 118*b*, 118*c* may correspond to one or more of the first HP, MP and LP heat exchangers 105*a*, 105*b*, 106*a*, 106*b*, 107*a*, 107*b*, 107*c* in the first refrigerant circuit 100. A cooled, preferably partially condensed, and pressurised refrigerant stream 48 is thus provided which is passed to a refrigerant separator 55. The refrigerant separator 55 is adapted to provide a light refrigerant stream 56 and a heavy refrigerant stream 57 in a manner known in the art, which refrigerant streams 56, 57 pass through the MCHE 54 for further cooling resulting in subcooled condensed refrigerant streams, are expanded by one or more valves and/or expanders 58*a*, 58*b*, before re-entering the MCHE 54 to provide cooling therein. The MCHE 54 provides a warmed refrigerant stream 59 for recompression in first and second main refrigerant compressors 45*a*, 45*b*. Second main refrigerant compressor 45*b* may be fitted with one or more intercoolers 43, such as one or more water and/or air coolers.

As described above, the first liquefied stream 50 from the MCHE 54 passes through a pressure reducing device, such as valve 52 into an end gas-liquid separator 62 such as an end-flash vessel, to provide an end gaseous stream 70 such as end-flash gas, and a liquefied hydrocarbon product stream 80. Alternatively the pressure reducing device may be an expander or a combination of valve and expander. The end gaseous stream 70 passes through one or more end-compressors 72 shown in FIG. 2 to be driven by an end compressor driver D4, to provide an end-compressed stream 90. A recycle fraction 90*b* of the end-compressed stream 90 is provided by a divider 91 to be fed into the methane-enriched stream 20.

Figure 3:
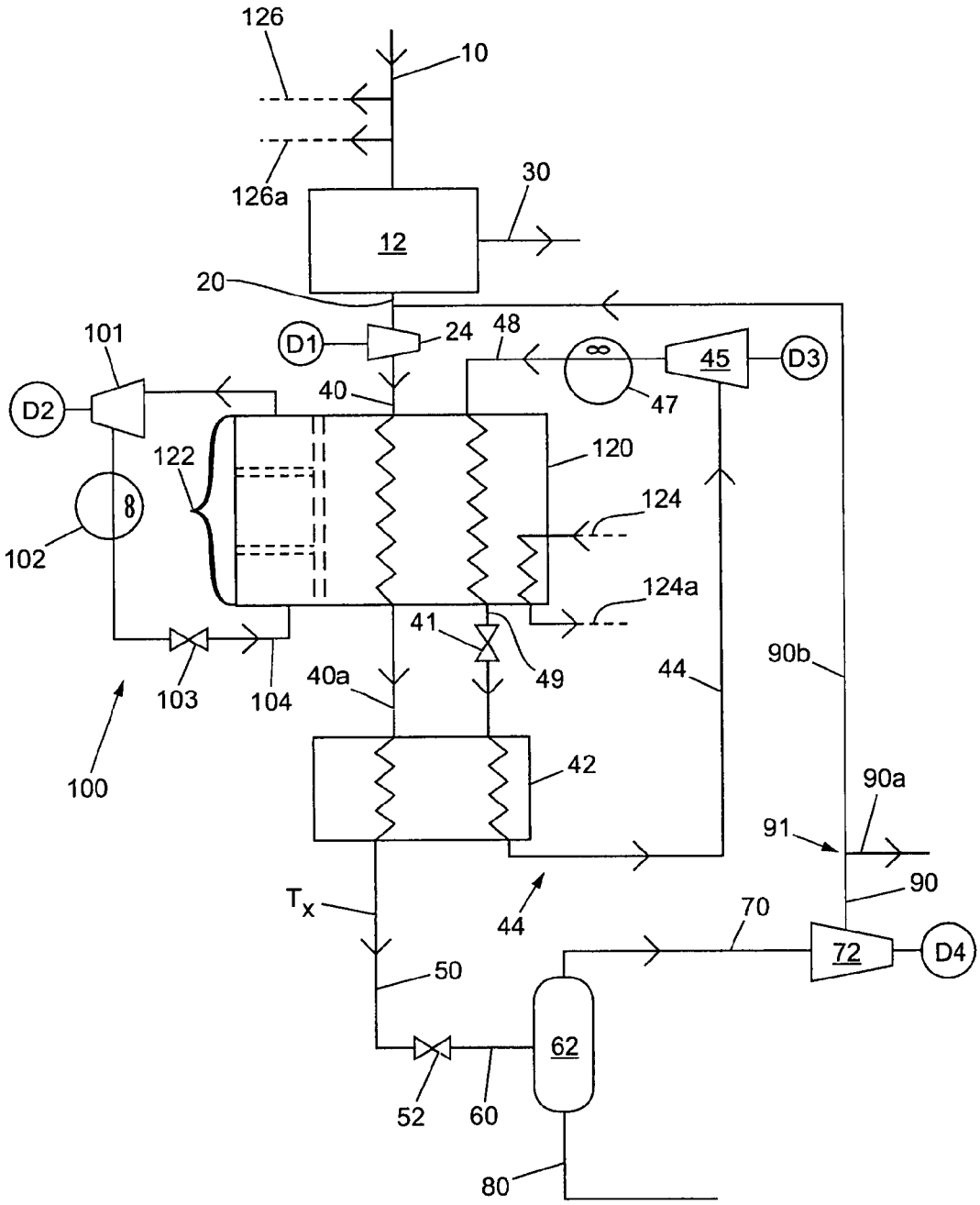
FIG. 3 is a more detailed diagrammatic scheme of another embodiment.

FIG. 3 shows an alternative layout for a method of liquefying a hydrocarbon stream according to a third embodiment. FIG. 3 uses the same arrangement as the embodiments shown in FIG. 2, with a different layout for the cooling provided by the first refrigerant circuit 100.

FIG. 3 shows a hydrocarbon feed stream 10 passing through a NGL recovery system 12 to provide a methane-enriched overhead stream 20, which passes through at least a first compressor 24 to provide a methane-compressed stream 40. FIG. 3 shows the first refrigerant circuit 100 comprising a first refrigerant compressor 101 driven by the first refrigerant compressor driver D2, and one or more coolers 102 and valves 103 thereafter.

FIG. 3 shows a heat exchange system 120 as a schematic representation of the provision of cooling by the first refrigerant circuit 100 to other streams in the method of liquefaction. The broken squares 122 of the heat exchange system 120 represent one or more actual heat exchangers, such as kettles, through which the first refrigerant of the first refrigerant circuit 100 can pass to provide cooling to the other streams shown passing through the heat exchange system 120.

The first refrigerant circuit 100 provides cooling to the methane-compressed stream 40 to provide a cooled methane-compressed stream 40*a* in the manner of the fourth heat exchanger system 116 in FIG. 2, and cooling to the main refrigerant of the main refrigerant circuit 44 (after its passage through the one or more main compressors 45 driven by main refrigerant compressor driver D3, and one or more coolers 47 to provide a cooled pressurised refrigerant stream 48) in the manner of the fifth heat exchanger system 118 shown in FIG. 2. Cooling of the cooled pressurised refrigerant stream 48 in heat exchange system 120 provides a further cooled pressurised refrigerant stream 49, which is passed to a valve 41 and then to main cooling stage 42.

Line 124 represents a further stream which can be cooled by the heat exchange system 120, to provide a cooled further stream 124*a*. Such cooling could be provided for example to the hydrocarbon feed stream 10 through lines 126 and 126*a* in a manner related to the second heat exchanger 112 shown in FIG. 2.

FIG. 3 shows that after passage of the cooled methane-compressed stream 40*a* through the main cooling stage 42, there is provided the first liquefied stream 50 having a temperature $T_x$.

The embodiments disclosed herein provide an advantageous method of liquefying a hydrocarbon stream wherein the pressure of an end-compressed stream 90 is the same or similar to the pressure of the methane-enriched overhead stream 20 following NGL recovery, such that direct recycle of at least a fraction of the end-compressed stream 90 is possible back into the liquefaction process.

The embodiments disclosed herein also provide a method of controlling the liquefaction of the hydrocarbon feed stream 10 comprising:

(i) liquefying the hydrocarbon feed stream 10 as described above;

(ii) adjusting the temperature $T_x$ of the first liquefied stream 50 shown in FIG. 3 to change the amount of the end gaseous stream 70 from the end gas/liquid separator 62; and (iii) controlling the amount of the recycle fraction 90*b* of the end-compressed stream 90 being fed into the methane-enriched stream 20 as the recycle fraction.

Adjusting the temperature $T_x$ of the first liquefied stream 50 allows the advantageous adjusting and/or shifting of the power requirements for one or more of the drivers of the compressors used in the liquefaction process.

For example, raising the temperature $T_x$ of the first liquefied stream 50 by a few degrees centigrade, such as from −144.5° C. to −140° C. or −130° C., increases the provision of the end gaseous stream 70 in the end gas/liquid separator 62, such that more power is required from the end-compressor driver D4 to compress the increased end gaseous stream 70, and more power is consequentially required by the first compressor driver D1 and the first refrigerant compressor driver D2 for the same recycle fraction 90*b* volume. However, less power is required from the main refrigerant compressor driver D3 (as the liquefaction temperature in the main cooling stage 42 is higher).

Conversely, decreasing the temperature $T_x$ reduces the provision of end gaseous stream 70, reducing the compressor drivers D4, D1 and D2 power loads (for the same recycle fraction 90*b* volume), but increasing the main refrigerant compressor driver D3 power load (so as to lower the liquefaction temperature).

The power loads of the compressor drivers D1-4 shown in FIGS. 2 and 3 can be further varied by controlling the amount of the recycle fraction 90*b* and fuel fraction 90*a*. There may be variation in the demand of the fuel fraction 90*a* by its one or more users, which determines the amount of the recycle fraction 90*b*.

FIG. 3 shows an interrelationship between the four compressor drivers D1-4 and the end stream splitter 91 that allows understanding of the variation therebetween.

In this way, the method of controlling the liquefaction of a hydrocarbon feed stream 10 provided herein allows the user to control the liquefaction process by shifting the power load between the compressor drivers for a given hydrocarbon feed stream flow.

For example, where one or more of the compressor drivers is constrained, i.e. already fully loaded and unable to provide any further compression of the stream therethrough, variation of one or more other of the other compressor drivers is possible to accommodate and if necessary relieve the constrained driver, by variation of the temperature $T_x$ of the final liquefied stream 50 and controlling the amount of the recycle fraction 90*b*. Typically, it is the first refrigerant compressor driver D2 or the main refrigerant compressor driver D3 which are constrained, being the bigger drivers in a liquefaction process.

The embodiments disclosed herein also provide a method of maximizing the production of the liquefied hydrocarbon stream 80 comprising at least the steps of:

controlling the liquefaction of the hydrocarbon feed stream 10 as described above, comprising the main refrigerant circuit 44, the one or more main refrigerant compressors 45, the first refrigerant circuit 100 and the one or more first refrigerant compressors 101; and driving each of the one or more main refrigerant compressors 45 and the first refrigerant compressors 101 at their maximum load.

In this way, it is possible to increase the liquefied hydrocarbon stream production by fully loading all the refrigerant drivers D1-4 where one or more of said drivers may not be otherwise required to be fully loaded.

For example, one or more of the drivers D1-4, especially the first refrigerant compressor driver D2 and the main refrigerant compressor driver D3, may have spare capacity, whilst still being able to provide, in relation to the other compressor drivers, the expected or 'normal' amount of liquefied hydrocarbon product.

The liquefied hydrocarbon stream may be a liquefied natural gas stream.

In the presently disclosed embodiments, control of the temperature $T_x$ of the first liquefied stream 50, and of the amount of the recycle fraction 90*b* of the end-compressed stream 90 allows maximization of at least the first refrigerant compressor driver D2 and the main refrigerant compressor driver D3 at full power, so as to provide an increase in the liquefied hydrocarbon product stream 80.

Table 1 below provides the power duties and other data for the drivers and certain streams at various parts of an example of the process disclosed herein such as that shown in FIGS. 2 and 3 herewith, in comparison with a process involving no recycle of the end-compressed stream, i.e. having no recycle fraction 90*b*.

TABLE 1

| Stream/Driver | Unit | Without Recycle | With Recycle |
|---|---|---|---|
| D1 | MW | 17.52 | 30.09 |
| D2 | MW | 89.20 | 90.19 |
| D3 | MW | 178.40 | 180.29 |
| D4 | MW | 68.79 | 77.75 |
| 80 | MTPA | 7.50 | 8.00 |
| 70 | kg/s | 23.03 | 41.11 |
| 90b | kg/s | 0.00 | 18.92 |
| Pressure of first compressor 24 | Bar | 25.15 | 25.15 |
| Temperature $T_x$ | ° C. | −149.9 | −144.5 |

Table 1 confirms that with similar power provided by the first refrigerant compressor driver D2 and the main refrigerant compressor driver D3, an increase of nearly 7% stream 80 (e.g. LNG) production can be provided by using a recycle fraction of the end-gaseous stream 90*b*, and by fully using the power available in the other compressor drivers D1 and D4.

Table 1 shows an example and comparative example (i.e. a process with and without recycle) in which the first refrigerant compressor driver D2 and the main refrigerant driver D3 operate at a full loading corresponding to their installed power outputs. In the comparative Example without recycle, the first compressor driver D1 and the end-compressor driver D4 operate at a level of consumed power significantly lower than their corresponding installed power. It is only in the example with recycle that drivers D1 and D4 can operate at a level of consumed power approaching their installed power.

Figure 4:
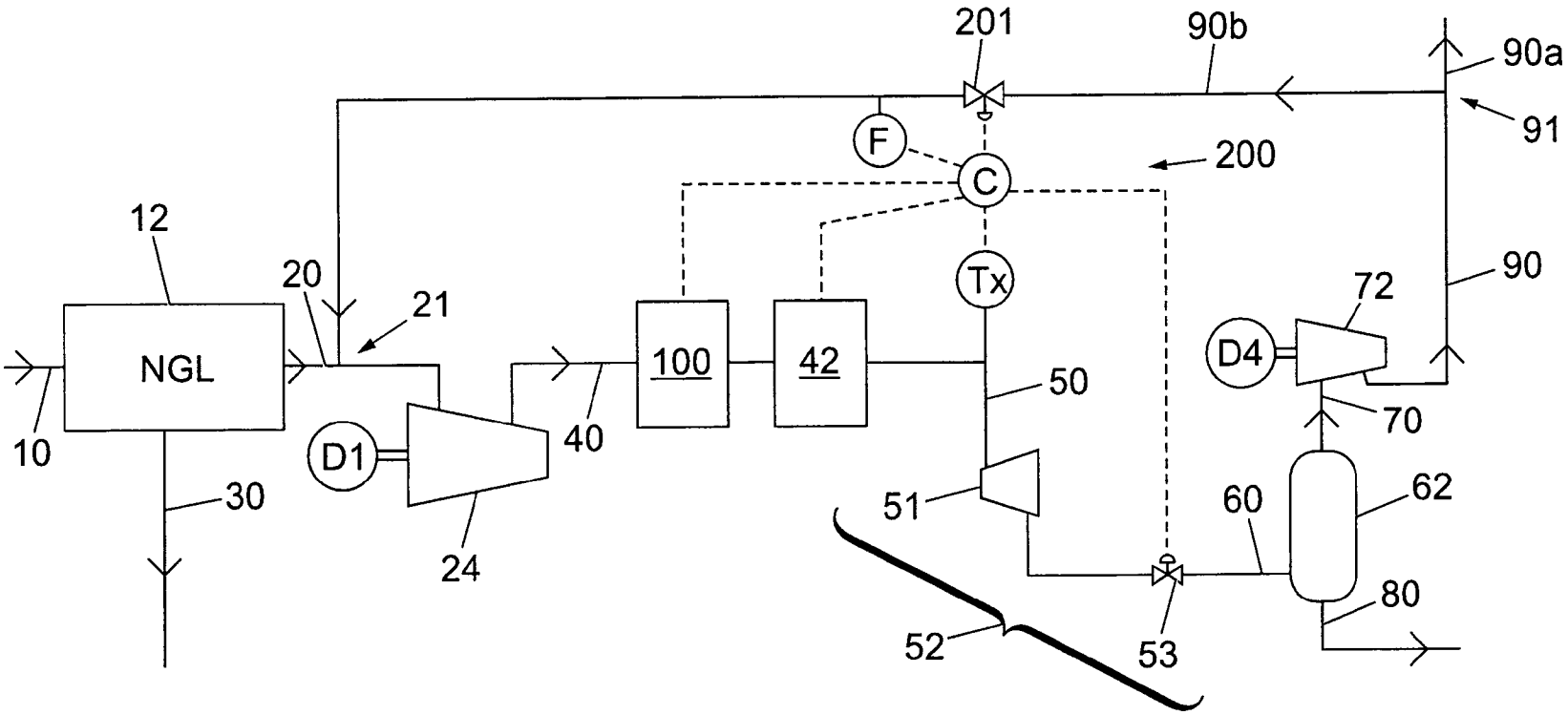
FIG. 4 is a diagrammatic scheme of an embodiment showing a controller.

FIG. 4 shows an example of how a control system 200 may be incorporated in the methods and apparatuses for liquefying a hydrocarbon stream as described above. The figures shows NGL recovery system 12, first compressor 24 and its driver D1, the first refrigerant circuit 100, the main refrigerant circuit 42, the pressure reduction device 52, the end gas/liquid separator 62, the end-compressor 72 and the recycle fraction line 90*b* arranged as described hereinabove. The pressure reduction device 52 in this example is embodied in the form of an expander 51 followed by a flow control valve 53 arranged in line 60 downstream of the expander 52. The control system 200 comprises a controller C that is arranged to maximize the loading power of the one or more main refrigerant compressors in the main refrigerant circuit 42 and the one or more first refrigerant compressors in the first refrigerant circuit 100 at their maximum load, by adjusting the temperature $T_x$ of the first liquefied stream 50 to change the amount of the end gaseous stream 70 from the end gas/liquid separator 62, and by controlling the amount in the recycle fraction line 90*b*. The temperature $T_x$ may be adjusted by calculating and imposing a new setpoint temperature $T_x'$ and arranging the control system to maintain the temperature $T_x$ as close as possible to a setpoint temperature $T_x'$ by manipulating the flow control valve 53. The amount in the recycle fraction 90*b* is flow controlled using the flow F, in accordance with a setpoint as well. This flow setpoint is translated by the controller C into a setting for the recycle control valve 201. Thus, the power loading of the first and main refrigerant compressors may be implemented in the control system 200 as controlled variables, and the control valve settings of the flow control valve 52 and the recycle control valve 201 may be regarded as being the manipulated variables.

The person skilled in the art will understand that the present invention can be carried out in many various ways without departing from the scope of the appended claims.

I claim:

1. A method of liquefying a hydrocarbon stream, comprising at least the steps of:

(a) providing a liquefaction system comprising at least an NGL recovery system, a main refrigerant circuit and a first refrigerant circuit and a pressure reducing device followed by an end gas/liquid separator, the main refrigerant circuit comprising at least one or more main refrigerant compressors, and the first refrigerant circuit comprising one or more first refrigerant compressors;

(b) passing a hydrocarbon feed stream through the NGL recovery system to produce a methane-enriched overhead stream from the hydrocarbon feed stream;

(c) passing the methane-enriched overhead stream through at least a first compressor to provide a methane-compressed stream;

(d) cooling the methane-compressed stream against a first refrigerant in the first refrigerant circuit and subsequently liquefying the methane-compressed stream against a main refrigerant in the main refrigerant circuit, to provide a first liquefied stream;

(e) reducing the pressure of the first liquefied stream to provide a mixed-phase stream;

(f) passing the mixed-phase stream through the end gas/liquid separator to provide an end gaseous stream and a liquefied hydrocarbon product stream;

(g) feeding at least a recycle fraction of the end gaseous stream into the methane-enriched overhead stream or the methane-compressed stream upstream of at least a part of said cooling against the first refrigerant in the first refrigerant circuit;

(h) maximizing the loading power of the one or more main refrigerant compressors and the one or more first refrigerant compressors to a predetermined maximum load by adjusting the temperature ($T_x$) of the first liquefied stream to change the amount of the end gaseous stream from the end gas/liquid separator and controlling the amount in the recycle fraction of the end gaseous stream being fed in step (g).

2. The method as claimed in claim 1, wherein said producing of the methane-enriched overhead stream in step (b) comprises extracting a C2+stream from the hydrocarbon feed stream and providing a C2+enriched bottom stream.

3. The method as claimed in claim 1, wherein the NGL recovery system comprises an expander, an NGL recovery column, and one or more turbo-compressors mechanically interlinked with the expander to be driven by the expander, and wherein step (b) further comprises:

passing at least a fraction of the hydrocarbon feed stream through the expander to provide a mixed-phase feed stream;

passing the mixed-phase feed stream into the NGL recovery column, which produces an overhead stream; and, passing the overhead stream through the turbo-compressor to produce the methane-enriched overhead stream.

4. The method as claimed in claim 3, wherein the pressure in the NGL recovery column is less than 40 bar.

5. The method as claimed in claim 3, wherein the pressure in the NGL recovery column is in the range from 15 to 45 bar.

6. The method as claimed in claim 1, wherein the first refrigerant circuit comprises at least one heat exchanger for cooling the hydrocarbon feed stream and at least one heat exchanger for cooling the methane-compressed stream.

7. The method as claimed in claim 1, further comprising passing the end gaseous stream through one or more end-compressors to provide an end-compressed stream prior to step (g) and wherein the recycle fraction of the end gaseous stream is drawn from the end compressed stream.

8. The method as claimed in claim 1, wherein the pressure of the methane-enriched overhead stream and the pressure of the recycle fraction of the end-compressed stream are in the range of 15 to 45 bar.

9. The method as claimed in claim 1, wherein the at least first compressor is commonly driven with at least one of the first refrigerant compressors.

10. The method as claimed in claim 1, wherein the hydrocarbon feed stream is a natural gas stream and the liquefied hydrocarbon product stream is a liquefied natural gas stream.

11. The method as claimed in claim 1, wherein said adjusting in step (h) of the temperature ($T_x$) of the first liquefied stream and said controlling of the amount in the recycle fraction of the end gaseous stream being fed in step (g) increases the production of the liquefied hydrocarbon product stream.

12. The method as claimed in claim 1, wherein said maximizing the loading power in step (h) comprises shifting of power load between the one or more first refrigerant compressors and the one or more main refrigerant compressors.

13. Apparatus for liquefying a hydrocarbon stream, the apparatus at least comprising:

an NGL recovery system to extract a C2+stream from a hydrocarbon feed stream to provide at least a methane-enriched overhead stream and a C2+enriched bottom stream;

at least a first compressor to provide a methane-compressed stream from the methane-enriched overhead stream;

a first cooling stage to cool the methane-compressed stream to provide a cooled methane-compressed stream, followed by a main cooling stage to liquefy the cooled methane-compressed stream to provide a first liquefied stream, wherein the first cooling stage comprises a first refrigerant circuit comprising one or more first refrigerant compressors and wherein the main cooling stage comprises a main refrigerant circuit comprising one or more main refrigerant compressors;

a pressure reducing device to reduce the pressure of the first liquefied stream to provide a mixed-phase stream;

an end gas/liquid separator to separate the mixed-phase stream into an end gaseous stream and a liquefied hydrocarbon product stream;

a recycle fraction line to feed at least a recycle fraction of the end gaseous stream into the methane-enriched overhead stream or the methane-compressed stream upstream of at least part of the first cooling stage; and a control system arranged to maximize the loading power of the one or more main refrigerant compressors and the one or more first refrigerant compressors at their maximum load, by adjusting the temperature ($T_x$) of the first liquefied stream to change the amount of the end gaseous stream from the end gas/liquid separator, and to control the amount in the recycle fraction of the end-compressed stream in the recycle fraction line.

14. The apparatus of claim 13, wherein the NGL recovery system comprises an expander arranged to expand at least a fraction of the hydrocarbon feed stream to provide a mixed-phase feed stream;

an NGL recovery column to receive the mixed-phase feed stream and to produce an overhead stream; and one or more turbo-compressors mechanically interlinked with the expander to be driven by the expander to receive the overhead stream and produce the methane-enriched overhead stream.

15. The apparatus of claim 13, further comprising one or more end-compressors to compress the end gaseous stream to provide an end-compressed stream, wherein the recycle fraction line connects the end-compressed stream with the methane-enriched overhead stream.

16. The apparatus of claim 13, wherein at least one of the one or more first refrigerant compressors and the at least first compressor are mechanically interlinked and commonly driven.

17. The method as claimed in claim 3, wherein the pressure in the NGL recovery column is ≤35 bar.

18. The method as claimed in claim 3, wherein the pressure in the NGL recovery column is in the range from 20 to 35 bar.

19. The apparatus as claimed in claim 13, wherein the at least first compressor is provided between the NGL recovery system and the NGL recovery system and the main cooling stage such that the methane-enriched overhead stream as obtained from the NGL recovery system is passed through said at least first compressor prior to passing into the main cooling stage.

20. The method as claimed in claim 1, wherein said methane-enriched overhead stream as obtained from the NGL recovery system is passed through said at least first compressor prior to said liquefying to provide said methane-compressed stream.

* * * * *